US006851833B1

(12) United States Patent
Simon

(10) Patent No.: US 6,851,833 B1
(45) Date of Patent: Feb. 8, 2005

(54) OPTICAL CONFIGURATIONS FOR DISTRIBUTING RADIALLY COLLIMATED LIGHT

(76) Inventor: Jerome H. Simon, 70 Sumner St., Newton Centre, MA (US) 02459

( * ) Notice: Subject to any disclaimer, the term of this patent is extended or adjusted under 35 U.S.C. 154(b) by 128 days.

(21) Appl. No.: 09/741,119

(22) Filed: Dec. 20, 2000

Related U.S. Application Data

(60) Provisional application No. 60/172,981, filed on Dec. 10, 1999.

(51) Int. Cl.[7] ..... F21V 5/04

(52) U.S. Cl. ..... 362/268; 362/335; 362/299; 362/328; 362/331

(58) Field of Search ..... 362/335, 338, 362/268, 298, 299, 308, 309, 328, 331, 337, 334, 340, 332

(56) References Cited

U.S. PATENT DOCUMENTS 4,962,450 A * 10/1990 Reshetin ..... 362/268
5,160,192 A * 11/1992 Sugawara ..... 362/16
5,897,201 A * 4/1999 Simon ..... 362/147

* cited by examiner

*Primary Examiner*—Sandra O'Shea
*Assistant Examiner*—Bertrand Zeade
(74) *Attorney, Agent, or Firm*—Perkins, Smith & Cohen; Harvey Kaye; Jerry Cohen

(57) ABSTRACT

A lighting assembly or a luminaire has a quasi point light source near a surface onto which light rays are to impinge. There is a lens system which includes a radially collimating first Fresnel lens at least partially surrounding the light source and collimating at least some of the light from the source to impinge upon the surface, and a second optical element, which may also be a Fresnel lens, for receiving light rays and directing the rays to impinge upon the surface at a position closer to the lens system than the rays from the first Fresnel lens. This provides more uniform lighting on the surface since the first Fresnel lens lighting impinges upon the surface at a distance from the assembly, and the second Fresnel lens provides fill in lighting between the assembly and the lighting of the first Fresnel lens.

34 Claims, 15 Drawing Sheets

4
L1
R2
L2B
L2A
L2
R3
R4
GP
7A
R1
7
2
1
3
B

L2C

A7
LC

1A
L1A
AH
L1
L2
O1

1D
AH
A2
A1
L1A
DS1
L1
O2
L2

A
3
2
1
L2
R1
P1
R2
RR1
CAL
A1
L1A
AH
A2
L2A
CAR
RR2
L1
P2
P 4A
4D
O
B
GP
A1
L2
2
L1
A
L1A
1C
L2A

B1

OA4
OA3
OA2
OA1
RR1
RR2
R1
R2
L1
L2
L'1
1/2
A
3
D1
D2
1
2

L1

L2
R1
PL
RR
AX
IS
1
2
Z4
RR4
Z3
RR3
Z2
Z1
OS
PL
RR2
L2

SP3
SP1
RR1
SP1
PPL

SN1
SN2
SN3
NLP
L2
L1
1
2
R1
Z6P
Z5P
Z4P
Z3P
Z2P
PPP
Z1P
Z1N
Z2N
Z3N
Z4N
Z5N
Z6N
IS
OS

NPL
NPL
L2
PPL
SP
SN

3
Z3B
Z3F
Z2B
Z2F
Z1B
Z1F
R3
R2
R1

GZ3
GZ2
GZ1
GP
IA
W

OPTICAL CONFIGURATIONS FOR DISTRIBUTING RADIALLY COLLIMATED LIGHT

CROSS REFERENCE TO RELATED APPLICATIONS

This applications claims the benefit of previously filed provisional application Ser. No. 60/172,981 filed Dec. 10, 1999, and which is hereby incorporated herein by reference.

FIELD OF THE INVENTION

This invention relates generally to the lighting art, and, more particularly to optical configurations for distributing radially collimated light.

BRIEF SUMMARY OF THE INVENTION

An object of the present invention is to provide architectural lighting in controlled areas of illumination that are distinct in shape and brightness.

Another object of the present invention is to provide for the distribution of radially collimated light in a manner which provides efficient use of the light source, and is flexible and can provide even illumination or, when desired, patterns of light.

These and other objects are accomplished according to the present invention in which a lighting assembly or a luminaire has a quasi point light source near a surface onto which light rays are to impinge. There is a lens system which includes a radially collimating first Fresnel lens at least partially surrounding the light source and collimating at least some of the light from the source to impinge upon the surface, and a second optical element, which may also be a Fresnel lens, for receiving light rays and directing the rays to impinge upon the surface at a position closer to the lens system than the rays from the first Fresnel lens. This provides more uniform lighting on the surface since the first Fresnel lens lighting impinges upon the surface at a distance from the assembly, and the second Fresnel lens provides fill in lighting between the assembly and the lighting of the first Fresnel lens.

Also, a lighting assembly is provided which has a quasi point light source near the surface onto which light rays are to impinge to provide light on the surface. Two canted lens ring segments at least partially surround the light source and collimate at least some of the light from the source to impinge upon the surface. These lenses each have an axis which is at an angle, to refract light rays from the source toward the surface. The lens ring segments may be aspherical or may be Fresnel lens elements.

Another form of the invention provides a lighting assembly having a quasi point light source near at least one surface onto which light rays are to impinge to provide lighting. There are two radially collimating Fresnel ring lenses adjacent each other and a quasi point light source is common to these lenses and arranged in the vicinity where the lenses are closest to one another. In this arrangement the lenses are arranged at an angle with respect to one another.

Other objects, features and advantages will be apparent from the following detailed description of preferred embodiments taken in conjunction with the accompanying drawings in which:

DETAILED DESCRIPTION OF THE DRAWINGS

Figures 1, 2, 3:
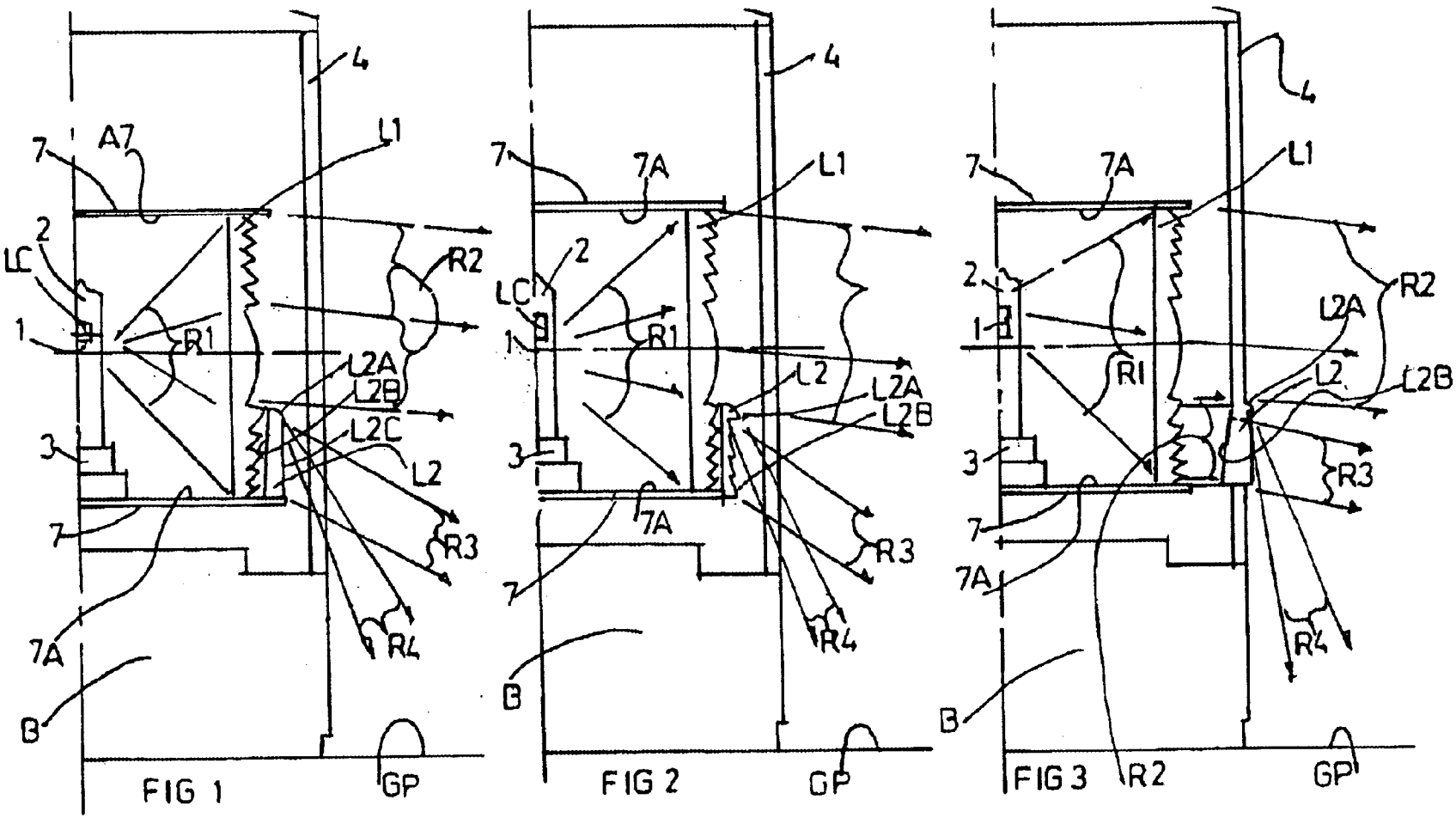
FIG. 1 is a partial sectional view of a luminaire of the present invention having a secondary lens.
FIG. 2 is a partial sectional view of a similar luminarie to that of FIG. 1 having a variation of the secondary lens.
FIG. 3 is a partial sectional view of a similar luminaire to that of FIGS. 2 and 3 having a further variation of the secondary lens.

FIGS. 1, 2, and 3 are partial section views of a luminaire designed to radially project light at an acute angle onto a surface GP which is axially perpendicular to axis A, and is similar to a fixture illustrated in my copending application Ser. No. 09/556,203, filed Apr. 24, 2000. The current luminaire has the addition of a ballast container B, which increases the distance between the lamp/optical assembly 1/L1 and the mounting surface GP. Rays R2, originating as Rays R1 from light center LC, are projected radially by Fresnel collimating lens ring L1 at an acute angle to mounting surface GP. A radial distance from the fixture exists before the rays R2 intercept the mounting surface GP leaving an area of GP without illumination.

In order to achieve an evenly illuminated area around the fixture L (which is the primary function of the luminaire), a secondary lens or refractor L2 is required. In the case of FIGS. 1, 2, and 3, refractor L2 is a ring that surrounds the lower portion of collimating lens ring L1 redirecting a portion of rays R2 toward the area immediately surrounding the luminaire. Refractor L2 of FIG. 1 is a radial wedge lens having a short focal convex surface L2A, which gathers and redirects radial rays R2 as rays R4, a broad radial flood toward and onto the adjacent surface of GP. The wedge portion of refractor L2, comprised of canted inner face L2B and external surface L2C, redirect rays R2 as rays R3 to a radial area that is between and not illuminated by rays R2 and R4. A predetermined photometric radial distribution of light on surface GP is achieved by the angular direction, the cross-sectional beam control, and the percentage of radiant light R1 that is refracted by L1 and by individual elements L2A, L2B, and L2C of L2. This pattern may be of a uniform or graduated brightness along a radius on surface GP.

There is an outer window jacket 4, an electrical socket 3 for the lamp 2, a cover 6, a light blocking element 7, a light blocking surface 7A on light blocking element 7, and central axis A which divides the fixture in half, only one half being shown in these figures.

FIG. 2 differs from FIG. 1 in that the wedge portion of L2 is comprised of multiple wedge segments L2B. The segments, which may be of any multiple, can be of equal tapers which will bend rays R2 within a consistent angle as rays R3 or can be varied tapers which will segment rays R2 into multiple radial rays. Refractor L2 also contains a lens segment L2A that is similar in cross-section and function to element L2A in FIG. 1. Refractor L2 may be made with a thin cross-section, possibly in the form of a film.

FIG. 3 differs from FIG. 1 in that refractor L2 is formed as part of outer window jacket 4. The optical cross-section of refractor L2 of FIG. 3 may be the same as refractor L2 of FIG. 1 or refractor L2 of FIG. 2.

Figure 4:
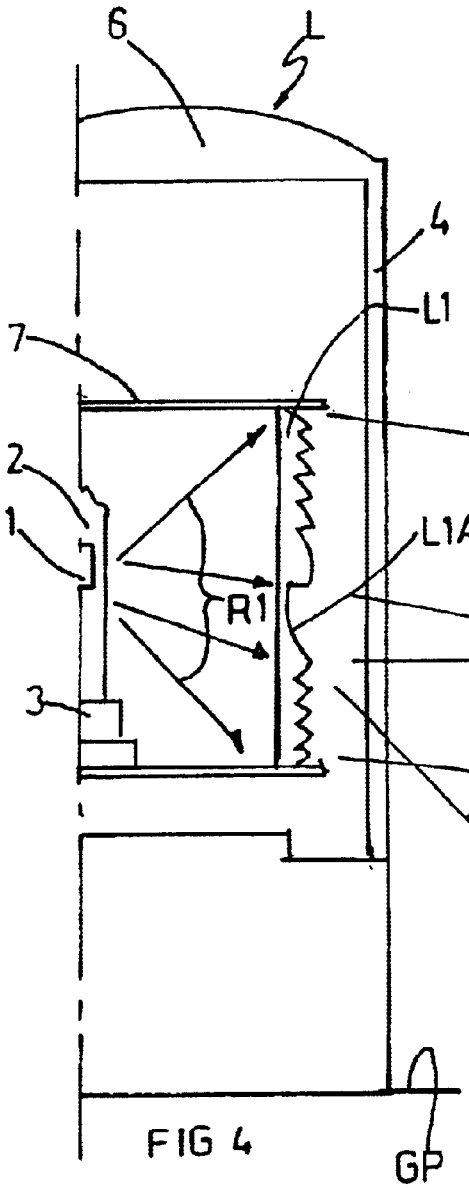
FIG. 4 is a partial sectional view similar to FIGS. 1-3 which does not have a secondary lens, but has a variation of the main lens.

FIG. 4 differs from FIG. 1 in that the near fixture illumination is provided by a cross-sectional concave surface L1A in lens L1, causing a portion of rays R1 to converge and be directed toward GP as a portion of rays R3 which blend with rays R2 on surface GP.

Figure 5:
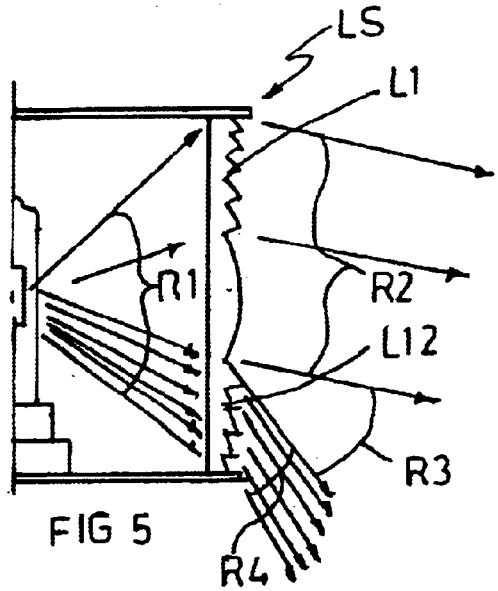
FIG. 5 is a partial sectional view similar to FIG. 4, but with a different variation of the main lens.

FIG. 5 is a partial view of luminaire L of FIG. 4 with an altered section of L1, being comprised of a series of wedge prisms L12 having differing refractive powers resulting in rays R3 and R4.

Figure 6:
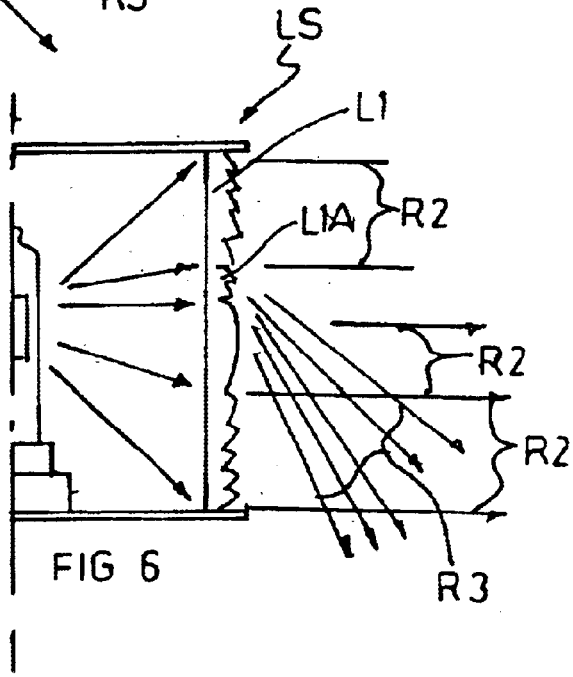
FIG. 6 is a partial sectional view similar to FIG. 5, but with a different portion of the main lens varied.

FIG. 6 is a similar configuration to FIG. 5, having a variation to the surface of L1 which includes sectionally convex rings L1A which substitute for a portion of the collimating rings normal to Fresnel ring L1. Convex rings L1A form a sectional ray pattern R3 of rays projected toward GP.

Figure 7:
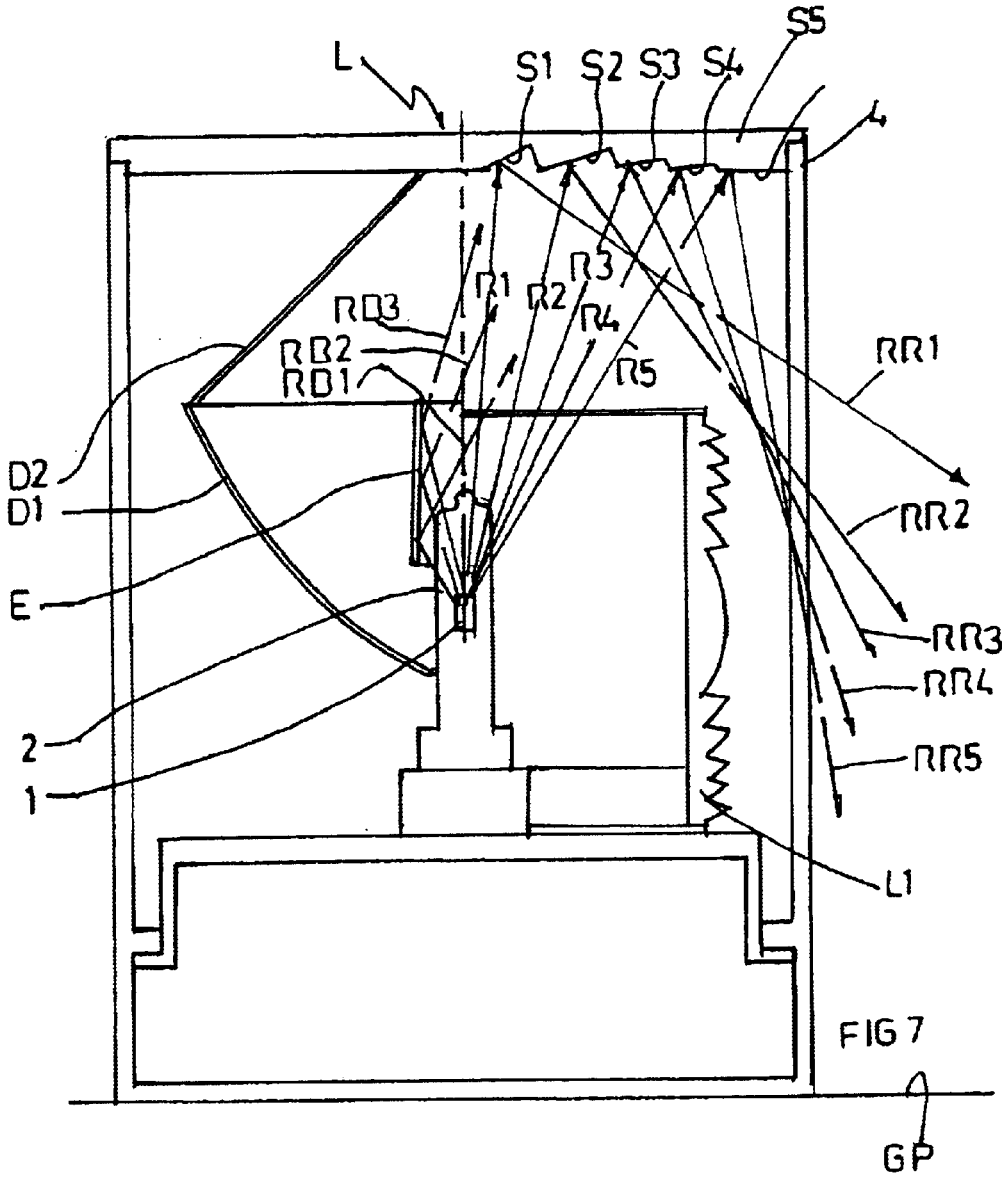
FIG. 7 is a cross sectional view of a luminaire having a reflector instead of the secondary lens of FIG. 1.

FIG. 7 is a cross-section of a luminaire that includes the main Fresnel collimating lens of FIG. 1 substituting reflector F for refractor ring lens L2. Reflector F is comprised of concentric reflecting rings S1, S2, S3, S4, and S5, each having a different angle in order to reflect rays R1, R2, R3, R4, and R5 (emanating from quasi-point source 1 of lamp 2) as reflected rays RR1, RR2, RR3, RR4, and RR5, respectively, that are reflected toward and onto mounting surface GP. Tubular concave cylindrical reflector E serves a double function: the first is to keep the back rays B1, B2 and B3 from reaching conical reflector D2; the second is to reflect rays B1, B2 and B3 as RB1, RB2, and RB3 respectively, adding brightness to GP as rays RB1, RB2 and RB3 are reflected by reflector F towards surface GP.

Reflector assembly D1 and D2 is described as to function and design in my copending application Ser. No. 09/556,203 filed Apr. 24, 2000, and which is hereby incorporated herein by reference.

Figure 8:
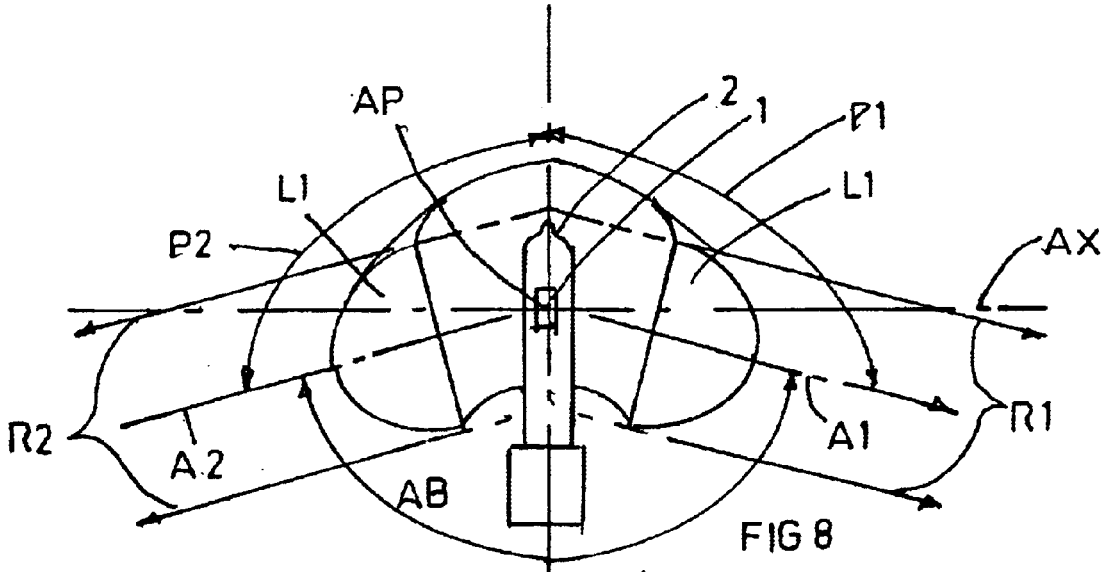
FIG. 8 is a sectional isometric view of a fixture which has two aspheric lens sections.

FIG. 8 is a three dimensional cross-section of two 180° aspheric (or spherical ring sections) L1 and L2 which are canted on lens axis A1 and A2, respectively. Axes A1 and A2 originate at point AP, which is the center of quasi-point source 1, and form an angle to the horizontal axis of the lamp center AX. This optical configuration creates two radiant planes of light, P1 and P2, of which ray sections R1 and R2 appear at angle AB to each other.

Figure 9:
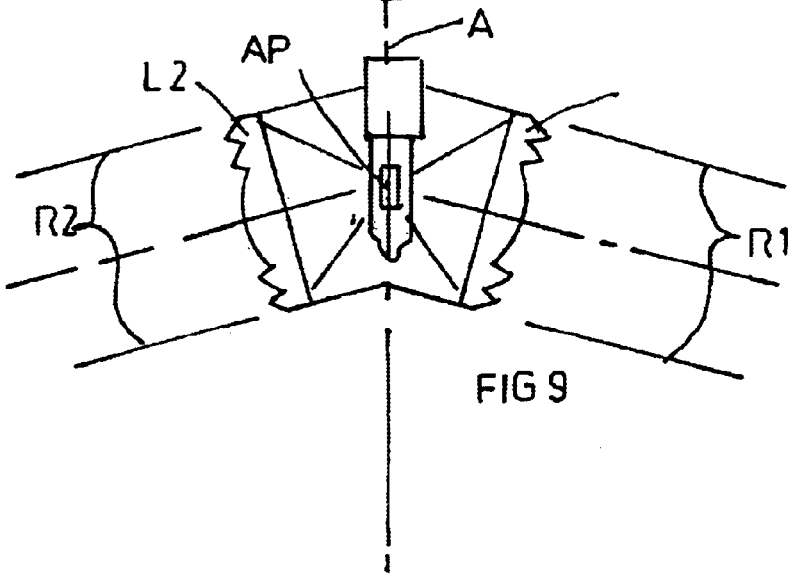
FIG. 9 is a partial sectional view similar to that of FIG. 8 in which the ring sections are Fresnel lenses.

FIG. 9 is a cross-sectional view of an optical configuration similar to that of FIG. 8, differing in that the ring sections L1 and L2 in FIG. 9 are Fresnel in section rather than plano-convex as in FIG. 8. Rays R2 and R1 are sections through canted radial beams. The 180° sections are illustrated by P2 and P1 respectively in FIG. 10.

Figure 10:
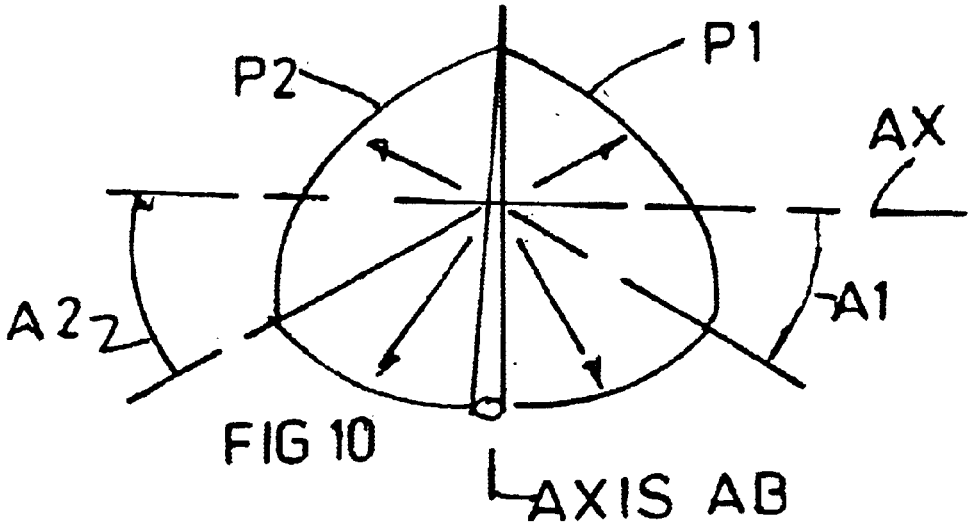
FIG. 10 is a plan-like view of the light arrangement of FIG. 9

FIG. 10 further illustrates the angular displacement of the two planar beams P1 and P2 away from light center AX as angles A1 and A2 respectively.

Figure 11:
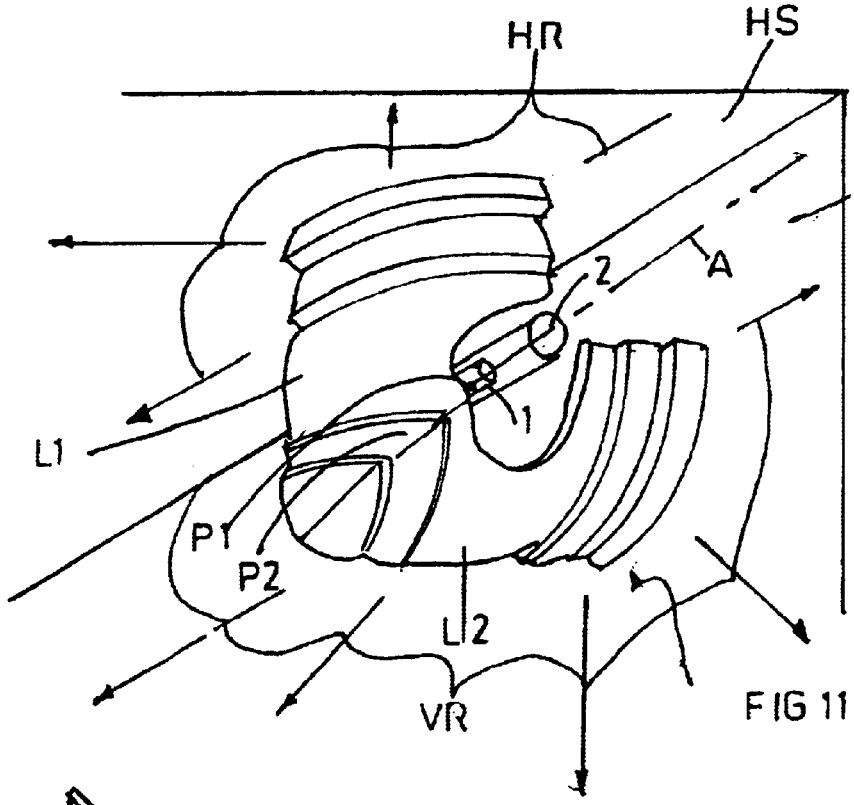
FIG. 11 is a schematic isometric view of a fixture with a double Fresnel lens.

FIG. 11 is a three dimensional view of a luminaire comprised of a light source L containing a quasi-point source 1 partially enclosed by two 180° Fresnel lenses L1 and L2. In FIG. 1, L1 and L2 are mounted at 90° to each other. Quasi-point source 1 is at the focal point P1 (that is on light axis A) of both L1 and L2. Light emanating from quasi-point source 1 is radially collimated by L1 as rays HR which strike and illuminate horizontal surface HS. In the same way, light emanating from quasi-point source 1 is radially collimated by L2 as rays VR, which strike and illuminate vertical surface VS.

If 1 is shifted from point P1 to P2 along light axis A, then HR would be canted conically at an acute angle towards HR and VR would be canted conically towards VS.

Both L1 and L2 may be constructed to include optics that illuminate the near radial of the surface directly surrounding the luminaire. These devices are illustrated in this application in FIGS. 1, 2, and 3, and FIGS. 4, 5, and 6, and in my co-pending application Ser. No. 09/556,203, filed Apr. 24, 2000.

Figure 12A:
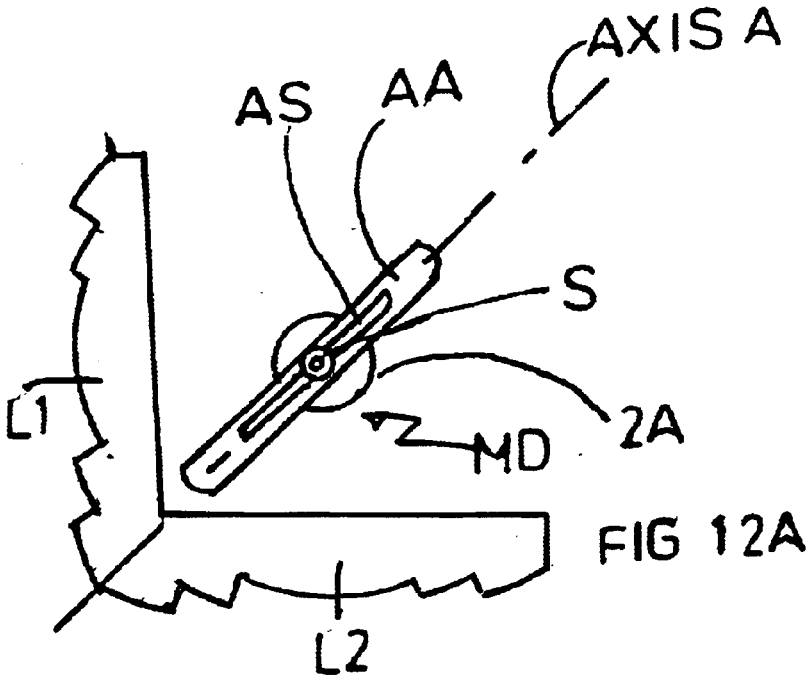
FIG. 12A is schematic partial sectional view of a device for changing the position of the lamp with respect to the lenses.
Figure 12:
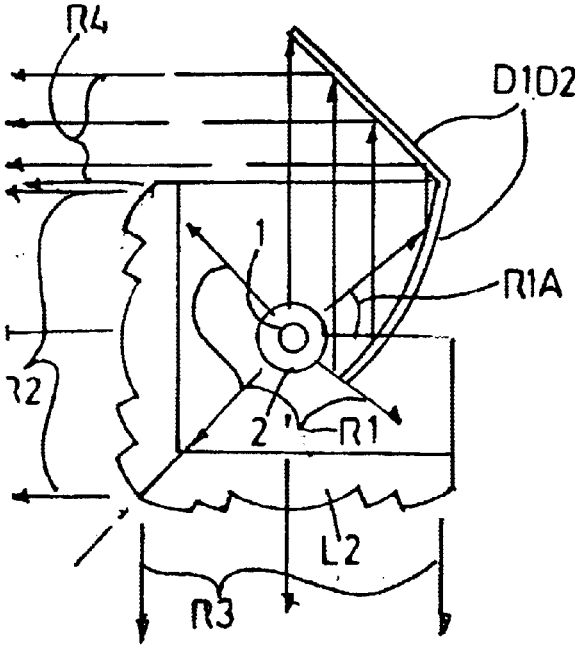
FIG. 12 is a cross sectional view of the structure shown in FIG. 11.

FIG. 12 is a cross-sectional view of FIG. 11 illustrating rays R1 emanating from quasi-point source 1 that are radially collimated by L1 and L2 as rays R2 and R3 respectively. In addition to L1 and L2 that partially surround the lamp 2, there is a reflector system D2D1 similar to that shown in FIG. 7 and D1D2 of Drawing Page 8, FIG. 19. Rays R1A, that emanate from quasi-point source 1 (and that are not collected by L1 and L2), strike parabolic reflector D1 and are reflected toward and onto conical reflector D2, and are then reflected by D2 as rays R4.

FIG. 12A is a diagrammatic view of a typical mechanical device MD for changing the relationship of light center 1 (FIGS. 11 and 12) to lenses L1 and L2. The mechanical device MD is comprised of a fixed ridged bar AA having a slot S which is parallel to axis A. A lamp/socket assembly 2A and a fastening head screw SC which is tapped into the socket of assembly 2A can be manually slid through slot S of bar AA. The head of screw SC may be tightened against and retained by bar AA (the shaft of the screw being engaged in the threads in the socket of assembly 2A) when the required position of light center 1 to lenses L1/L2 is determined and/or is to be changed.

Figure 13:
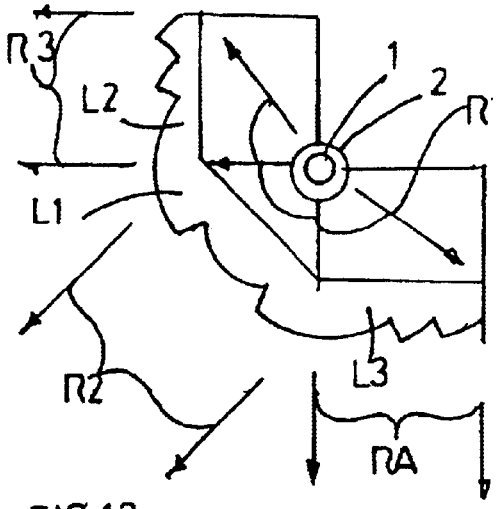
FIG. 13 is a schematic view of a three Fresnel lens arrangement.

FIG. 13 shows a geometric configuration (in section) of three radial Fresnel lens L1, L2, and L3 collecting light R1 and projecting it as radial beams R2, R3, and R4 respectively.

Figures 14, 15, 16, 17:
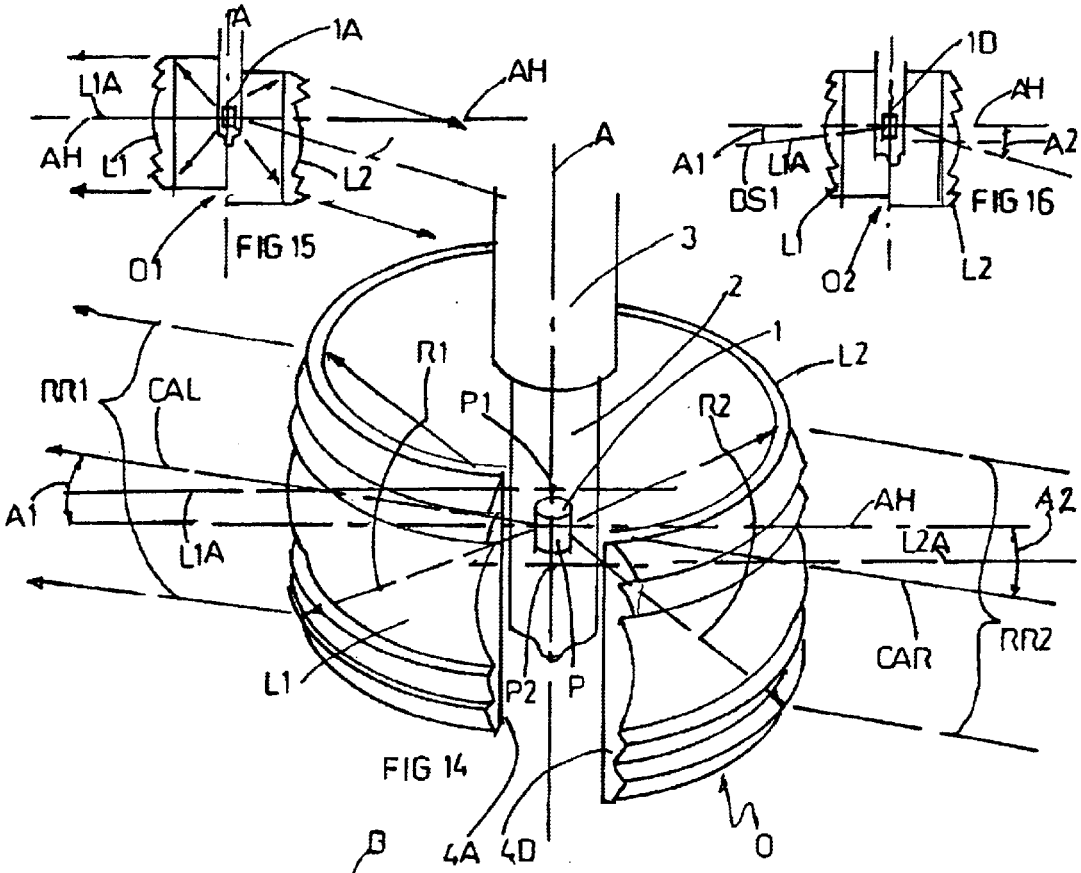
FIG. 14 is an isometric view of a fixture with parts broken away for clarity.
FIG. 15 is a schematic cross sectional view of an optical system similar to that shown in FIG. 14.
FIG. 16 is a schematic cross sectional view of an optical system similar to that shown in FIG. 14.
FIG. 17 is a plan view of the illumination pattern for the system of FIG. 16.

FIG. 14 is an isometric cutaway view of an optical system O comprised of lamp 2 containing quasi-point source 1 mounted in electrical socket 3 with Lamp 2 surrounded by 180° collimators L1 and L2. Quasi-point source 1 is located on point P, which is at the juncture of the vertical axis A of source 1 and the horizontal light axis AH of source 1. The center axis L1A of collimator L1, lies above AH and intersects vertical axis A at P1, causing L1 to project collected rays R1 as collimated rays RR1 at a conically acute angle A1 radially upward from L1. Similarly, the center axis L2A of lens L2, intersects vertical axis A at point P2 which lies below the intersection of horizontal light axis AH and vertical light axis A, causing L1 to project collected rays R2 as collimated rays RR2 at a conically acute angle A2 radially downward from L2.

FIG. 15 is a cross-sectional diagram of an optical system similar to that of FIG. 14, with the following difference. The light center axis L1A of L1 is the same as the horizontal light axis AH of quasi-point source 1A. Lens L2 is in a relationship to source 1A similar to that of lens L2 to source 1 in FIG. 14.

FIG. 16 is a cross-sectional diagram of an optical system O2 similar to that of FIG. 14 with the following differences. Both L1 and L2 have their light center axis L1A and L2A below the horizontal axis AH of quasi-point source 1B. The distance between source axis AH and lens axis L1A is less than the distance between AH and L2A. Therefore, the angle A1 at which the beam center BS1 is projected is less than the angle A2 at which beam center BS2 is projected.

FIG. 17 is a plan of luminaire L1 containing four 90° Fresnel ring sections, L1 and L1A, and L2 and L2A. The light center axis of all four lenses is below (closer to surface GP than) quasi-point source 1C. The distance of light center axis of L1 and L1A to the light center 1C is greater than the distance between the light center of L2 and L2A, and therefore the projection angle of light from L1 and L1A is more obtuse toward surface GP than light projected from L2 and L2A; which results in the differing sizes of beam spreads bordered by A and A1 and B and B2 respectively.

Figure 18:
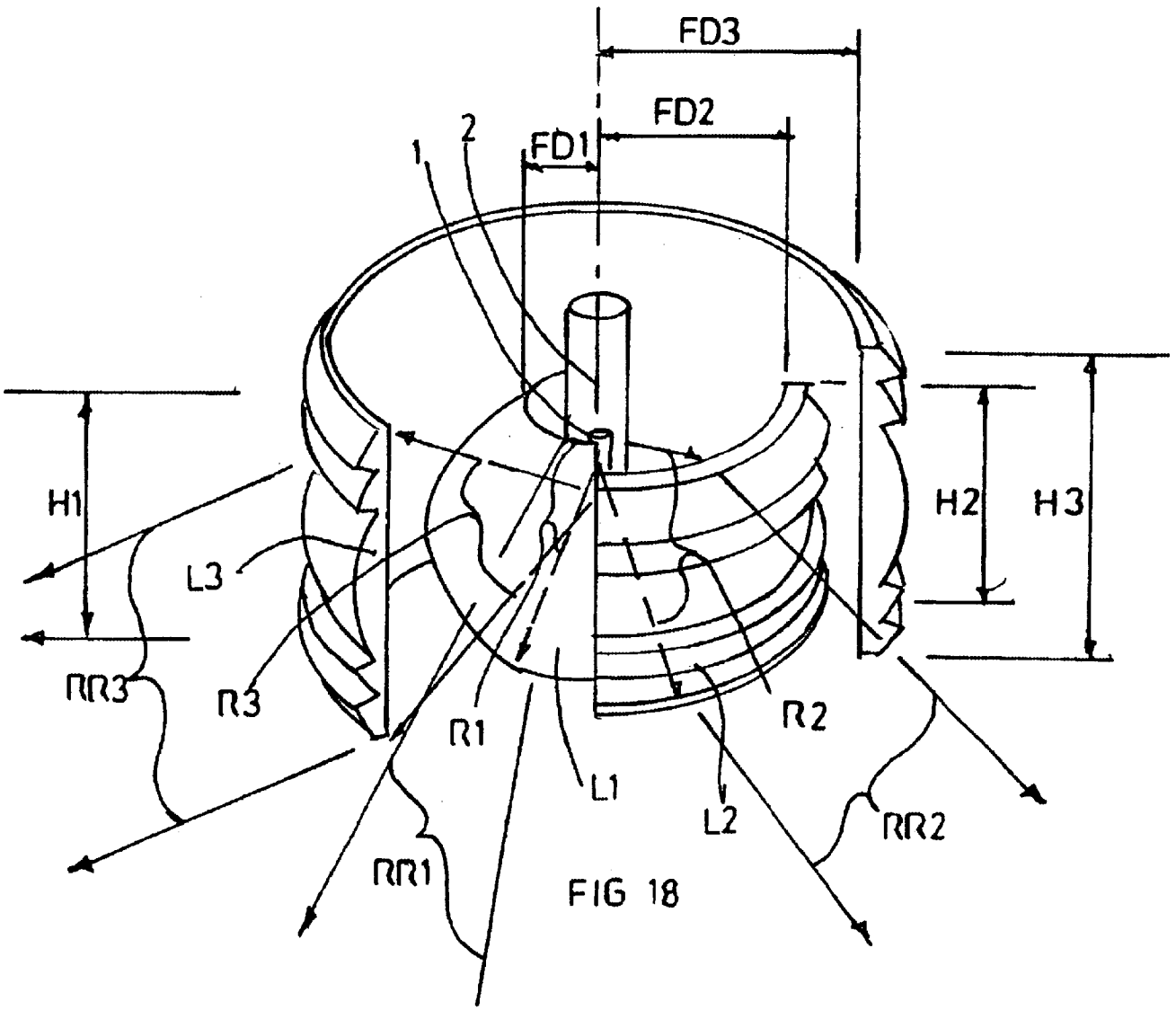
FIG. 18 is a schematic isometric view of a luminaire having three lens segments.

FIG. 18 is an optical assembly that contains quasi-point source 1 of lamp 2 surrounded by radially collimating arc segment lenses L1, L2 and L3, which have equal (or nearly equal) F numbers (the ratio of height to distance from 1 [FD1 divided by H1, FD2 by H2 and FD3 by H3, respectively]). Rays R1, R2 and R3 emanating from source 1 are collected by lens segments L1, L2, and L3. Rays RR3 projected by lens segment L3 are projected at a greater degree of collimation (less beam divergence) than rays RR1 projected by segment L1. This is achieved by segment L3 having the ratio of its height H1 to the vertical dimension of source 1 greater than the ratio of segment L2 to lamp 1 which is greater than the ratio of segment L1 to source 1, this ratio being a determining factor to the divergence control of a light collection system.

Figures 19, 20, 21, 22, 23, 24:
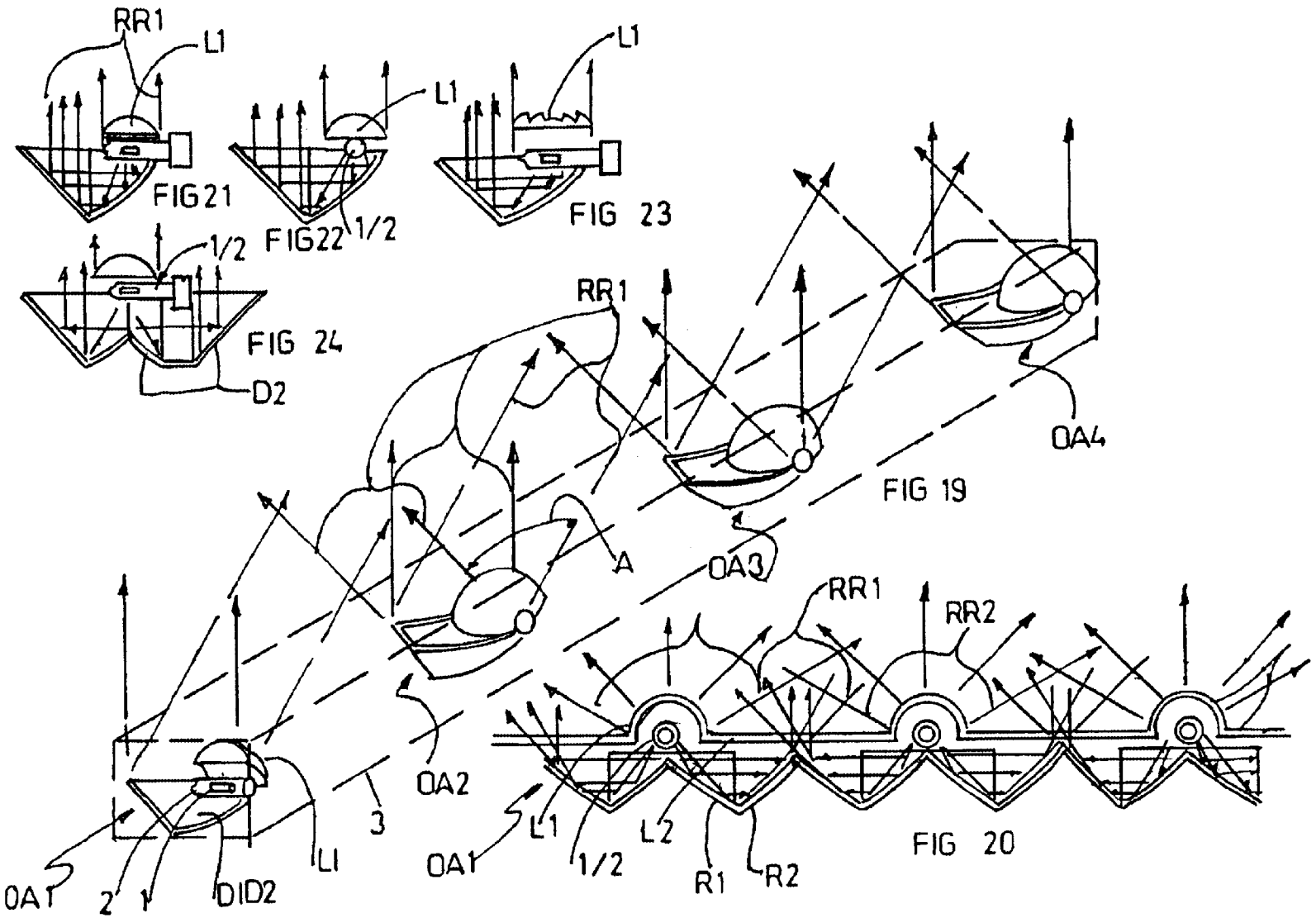
FIG. 19 is a schematic isometric view of a series of optical assemblies.
FIG. 20 is a cross sectional view of an optical assembly similar to the one shown in FIG. 19.
FIG. 21 is a cross sectional view of the optical assembly of FIG. 20.
FIG. 22 is a cross sectional view of the optical assembly of FIG. 20.
FIG. 23 is a cross sectional view of the optical assembly of FIG. 20.
FIG. 24 is a cross sectional view of the optical assembly of FIG. 20.

FIG. 19 is an isometric view of a series of optical assemblies OA1, OA2, OA3 and OA4 mounted in trough 3 (shown in dashed lines for clarity) which may be extruded, bent, or drawn or constructed in any suitable material. The trough 3 may also carry electrical power to power the lamps within the optical assemblies. Each optical assembly OA1 through OA4 is designed to project rays RR1 at a radial angle A which may vary between 10° and 180°, which provides an overlapping beam pattern from OA1 through OA4. Optical assemblies OA1 through OA4 have a similar optical function to that of fixtures illustrated in my copending application Ser. No. 09/556,203.

FIG. 20 is a cross-sectional view of a configuration of an optical assembly similar to that of FIG. 19. A quasi-point source lamp 1/2 is partially surrounded by lens L1 producing radially collimated rays RR1. Rays that are not collected by lens L1 are collimated by parabolic reflector R1 and directed toward reflector R2 which radially redirects these rays as radially distributed rays RR2.

FIG. 21 is a section of optical assembly OA1 (with lens L1 being spherical or aspherical) illustrating a sectional view of rays RR1 in FIG. 20.

FIG. 22 is a similar section view to FIG. 21 showing Lamp 1/2 in a transverse position to lens L1.

FIG. 23 is a similar section view to FIG. 21 with lens L1 having a Fresnel section.

FIG. 24 is a similar section view to FIG. 21 with the addition of reflector assembly D2 which projects a portion of the collected light under lamp 1/2.

Figure 25:
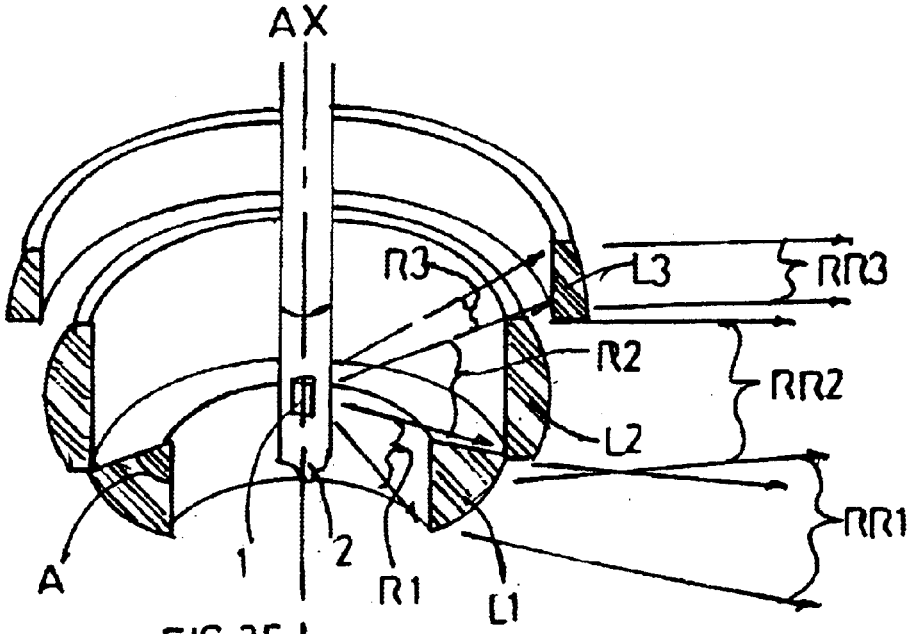
FIG. 25 is a cross sectional isometric view of an optical system having three ring lenses.

FIG. 25 is a cross-sectional isometric view of an optical system containing light emitting quasi-point source 1 within lamp 2 emitting light that is illustrated cross-sectionally as rays R1, R2, and R3 that strike ring lenses L1, L2, and L3 respectively. Ring lenses L1, L2, and L3 are concentric to lamp 1 and each other and offset vertically about central light axis AX. Each ring lens segment is a radial segment section of a collimating ring lens resulting in radially projected beams RR1, RR2, and RR3 being collimated in a substantially parallel direction to one another.

Figure 25A:
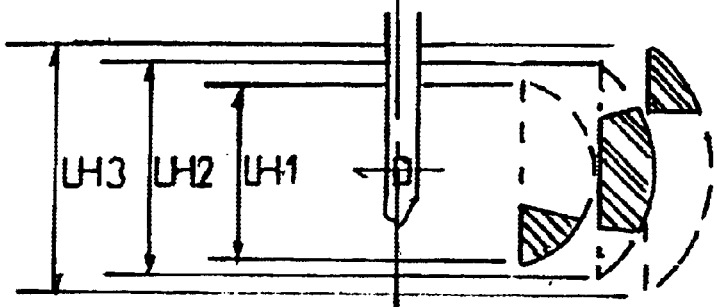
FIG. 25A is a diagrammatic view of the ration of lens height to lamp height of the three lenses in FIG. 25.

FIG. 25A illustrates the ratio of the full section height of lens L1 (as L1H) to the height of lamp 1 being less than the ratio of the full section height of lens L2 (as L2H) to lamp 1, and the ratio of the full section lens L3 (as L3H) being greater than that of lens L2 to lamp 1. Since the degree of collimation is determined by the ratio of a lens to the size of the quasi-point source, the sectional rays RR1 are more divergent (less collimated) than RR2 which are more divergent than RR3, RR3 having the greatest degree of collimation.

Figures 26, 26A, 27, 27A, 27B:
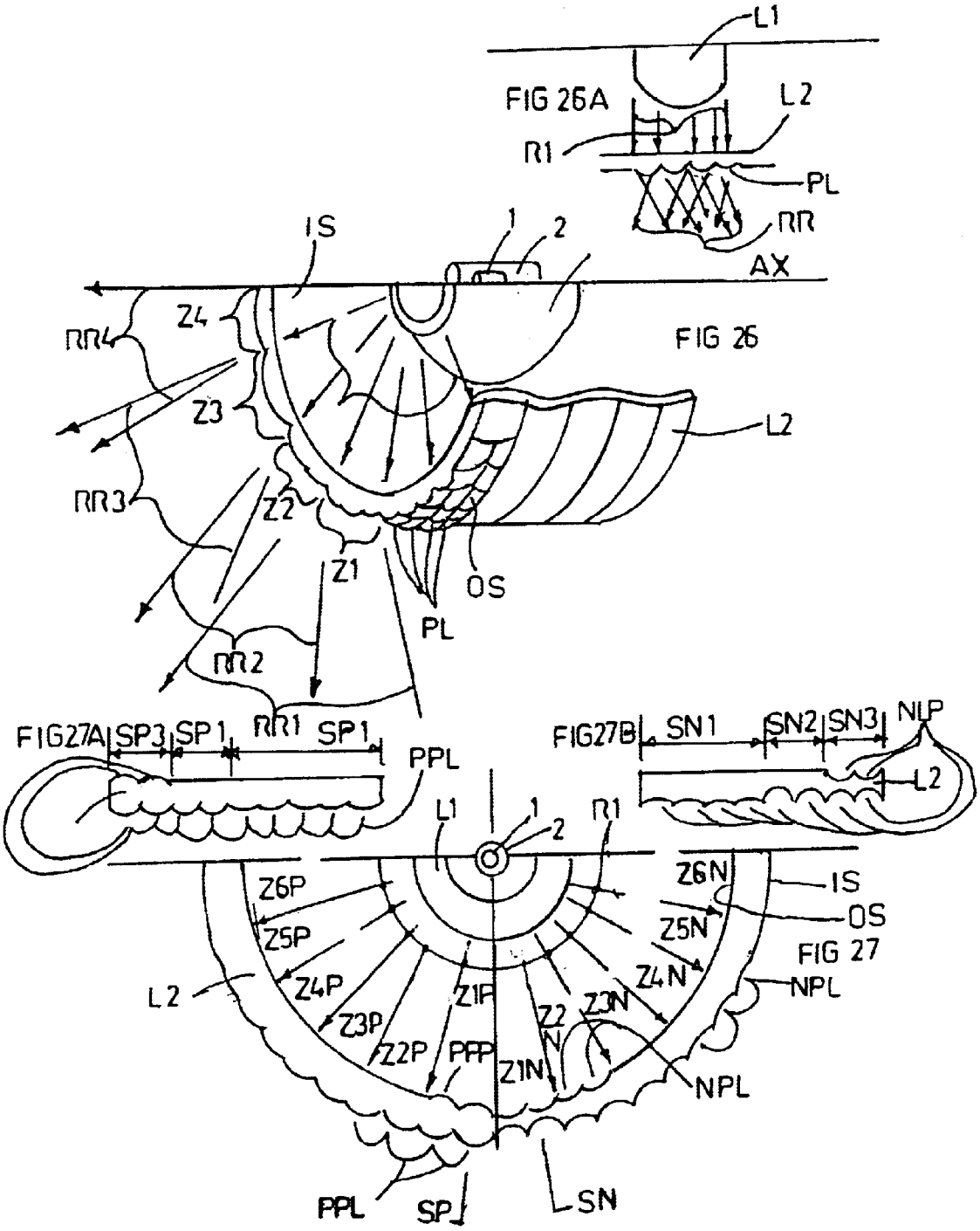
FIG. 26 is an isometric view of an optical system having a collimator ring and a refracting ring.
FIG. 26A is a partial side view of a portion of the optical system of FIG. 26.
FIG. 27 is a cross sectional of an optical system similar to that of FIG. 26.
FIG. 27A is a cross sectional view of one type of lenses usable in FIG. 26 and/or FIG. 27.
FIG. 27B is a cross sectional view similar to FIG. 27A of another type of lenses usable in FIG. 26 and/or FIG. 27.

FIG. 26 is an isometric view of an optical system having a quasi-point source 1 contained in a lamp 2 that is partially surrounded by a light collecting ring collimator L1, which itself is being surrounded by a refracting ring L2 which may or may not be concentrically disposed to ring collimator L1. Refracting ring L2 is comprised of an inner surface IS and an outer surface OS. In FIG. 26 outer surface OS is divided into zones. For graphic purposes only, 90° of refracting ring L2 is shown to have zones which are numbered sequentially as Z1, Z2, Z3, and Z4 around the circumference of ring L2. Each zone is comprised of positive pillow lenses PL, the ones with the greatest power being located within zone Z1, those with lesser power at Z2, those with even lesser power at Z3 and those with the least power at Z4. (Although the change of powers and their related zones follows a particular sequence in FIG. 26, any sequence about ring L2 can be fabricated.) The greater the power of the pillow lens the wider divergence of light will be after passing through the lens. Rays R1 projected by collimator L1 are refracted at the greatest diverging angle at Z1 as rays RR1, with a lesser degree of divergence at Z2 as rays RR2 and lesser divergence at zone Z3 as rays RR3, and with the least divergence of rays R1 at zone Z4, as rays RR4, where the power the of pillow lens(es) is the lowest of the zones.

FIG. 26A is a partial side view of FIG. 26 illustrating a section of rays R1 being collimated by L1 and refracted by PL of L2 as diverging rays RR.

FIG. 27 is a cross-section of an optical system similar to that of FIG. 26, illustrating a refracting lens L2 that contains 12 zones. Zone Z1P contains positive pillow type surfacing both on outer surface OS and inner surface IS. Zones Z2P through Z5P have positive pillow type surfacing with corresponding decreasing power. Zone Z6P contains no pillow lens surface allowing rays R1 to pass through lens L2 without additional divergence. Zone Z1N has negative pillow surfacing on outer surface OS and inner surface IS. Zones Z2N through Z5N have negative pillow type surfacing with corresponding decreasing power. Zone Z6N is similar to Zone Z6P.

FIG. 27A is a cross-section of lens L2 of FIG. 26 or lens L2 of FIG. 27 illustrating one possible sequence of changes in refracting power of positive pillow lenses along its cross-sectional length. FIG. 27A has three cross-sectional divisions: SP3, SP2, and SP1. Division SP3 has a double positive profile, the lenses of which have the greatest power of the three. Division SP2 has a single positive profile, and division SP1 has a single positive profile, the lenses of which having less power than those of division SP2.

FIG. 27B is a cross sectional view similar to FIG. 27A and contains divisions SN3, SN2, and SN1 all containing negative pillow profiles. Division SN3 has double negative surfaces, division SN2 has single negative surfaces, and division SN1 has single negative surfaces with less power than those of division SN2.

Figure 28:
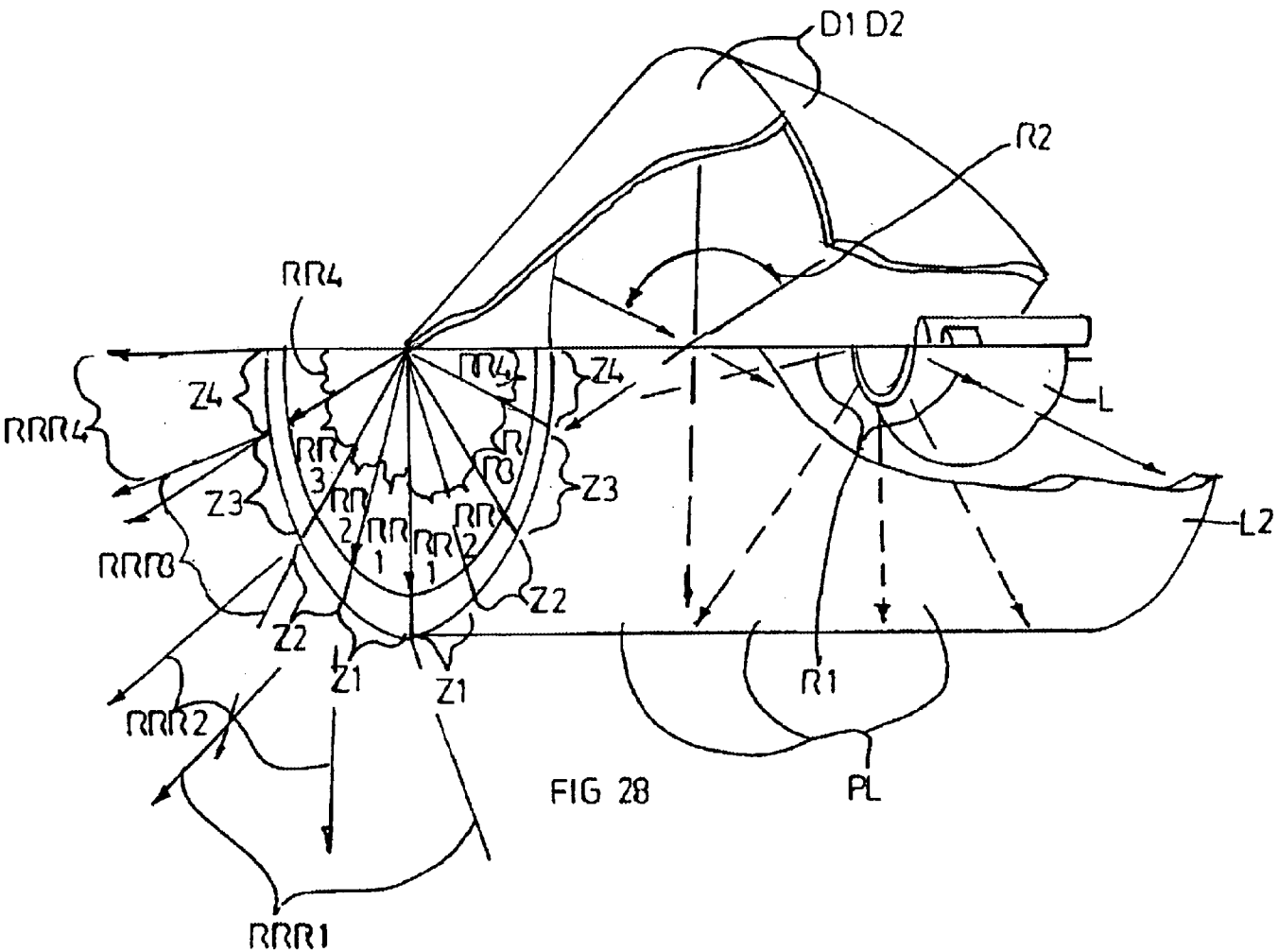
FIG. 28 is schematic isometric view of an optical system using a lens cylinder.

Although the surface of lens L2 of FIGS. 26, 27, and 28 contain pillow lenses, other refractive elements may be used, such as positive and negative cylinder lenses, V-shaped prisms, and pyramids.

FIG. 28 contains an optical system similar to that of my co-pending application Ser. No. 09/556,203 filed Apr. 24, 2000, with the addition of lens cylinder L2.

Rays R1 projected by lens L as in lens L1 of FIG. 26, and rays R2 projected by reflector assembly D1/D2, which are essentially parallel to each other in a radial direction, strike cylinder lens L2 and are refracted by pillow lenses PL (not shown in FIG. 28) having a similar function to lenses PL of FIGS. 26, 26A, 27, 27A and 27B. Zones Z1 through Z4 refract rays RR1 through RR4 as diverging rays RRR1 through RRR4.

Figure 29:
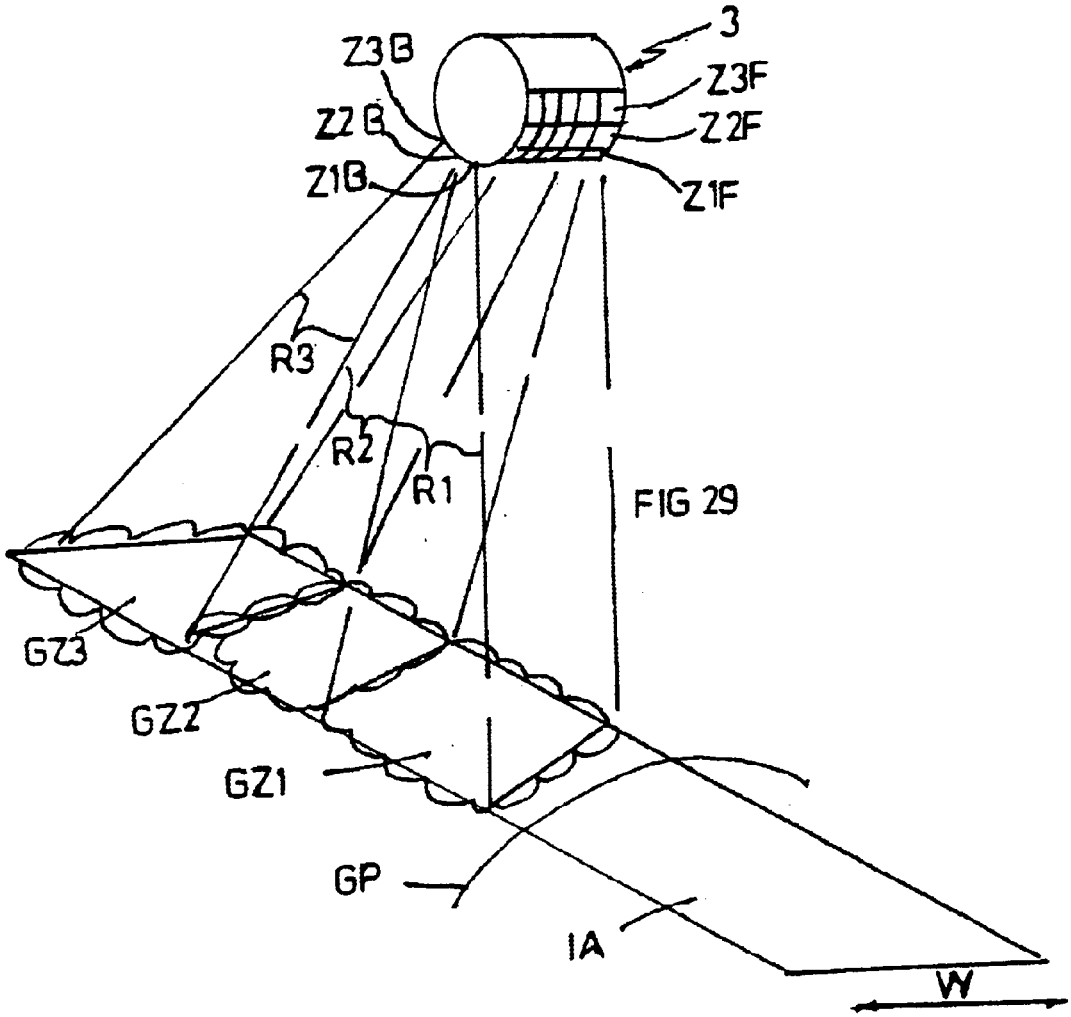
FIG. 29 is a diagrammatic isometric view of a lighting fixture which may provide even lighting over a defined geometric pattern.

FIG. 29 illustrates a lighting fixture 3 that can be mounted on a pole or wall above ground plane GP. The purpose of lighting fixture 3 is to provide an area of illumination IA onto GP, which maintains a controlled width W over the length of IA at a relatively even brightness. Lighting fixture 3 contains an optical system similar to that of FIG. 26 or FIG. 28. For graphic and example purposes only, three zones containing pillow lenses are illustrated as Z1F, Z2F and Z3F. Lighting fixture 3 has three similar zones on the non-visible side of fixture 3 (not visible in FIG. 29), Z1B, Z2B, and 3B.

Lighting fixture 3 achieves its purpose through the rate of divergence over distance of the light emanating from each zone to the surface onto which the light is projected. Zone Z1B projects light ray R1 at the greatest divergence as rays R1 over the shortest distance to IA as area GZ1. Zone Z2B projects a less divergent beam as rays R2 at a greater distance to provide lighted area GZ2, and zone Z3B projects the least divergent beam R3 over the greatest distance to provide lighted area GZ3.

Figure 30:
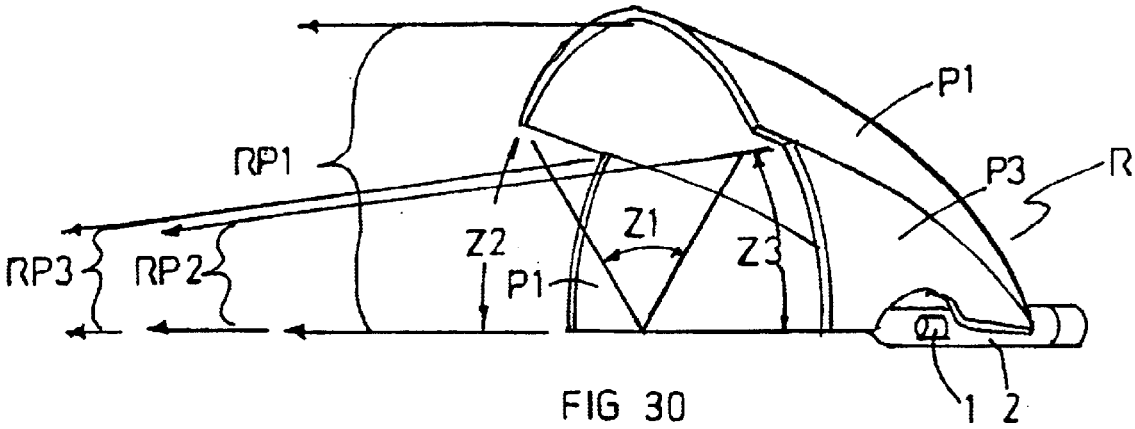
FIG. 30 is a schematic isometric view of a reflector system having multiple reflector sections.

FIG. 30 is a three dimensional view of a reflector system R surrounding quasi-point source 1 within lamp 2. Reflector system R is comprised of (but not limited to) three reflector sections which are described as follows. Section P1 is parabolic in section and projects a collimated beam RP1. Reflector sections P2 and P3 share an ellipsoidal section and project converging beam RP2/RP3. The combined beam projections RP1 and RP2/RP3 produce a 180° in section columnar beam that has varying divergence and concentric brightness. Other combinations of reflector segments may include parabolas with differing focal lengths and F numbers, ellipsoids of varied focal distances, and spherical sections of differing diameters.

Figure 31:
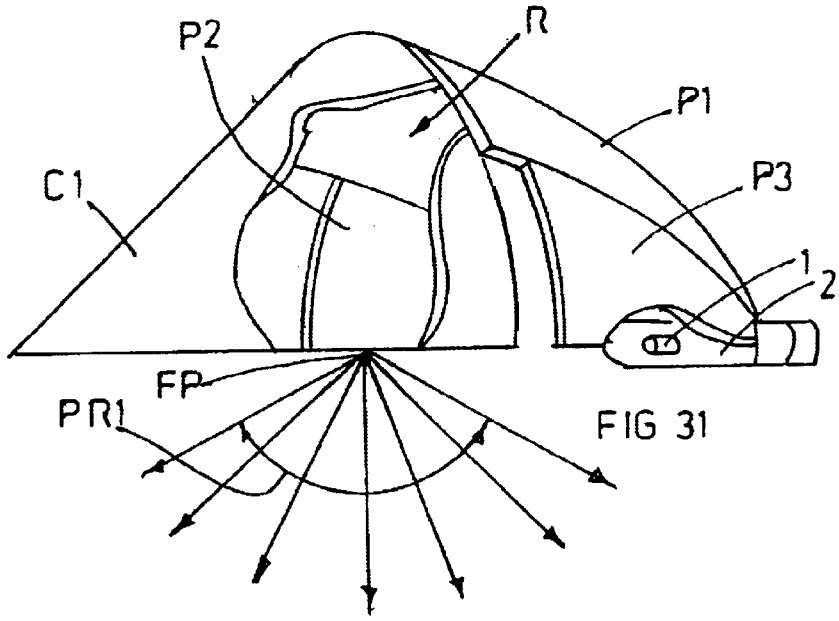
FIG. 31 is a schematic isometric view of the system of FIG. 30 which has a cone reflector intercepting the light beams.

FIG. 31 contains the same reflector configuration as FIG. 30, with the addition of cone reflector C1 which is positioned to intersect the beams RP1, RkP2 and RP3 and redirect them to the focal point at from which these beams then diverge as shown at the bottom of the figure. Thus, cone reflector C1 collects and redirects columnar beams RP1 and RP2/RP3 of FIG. 30 as a radially collimated beam, a section of which is represented as rays PR1.

Figure 32:
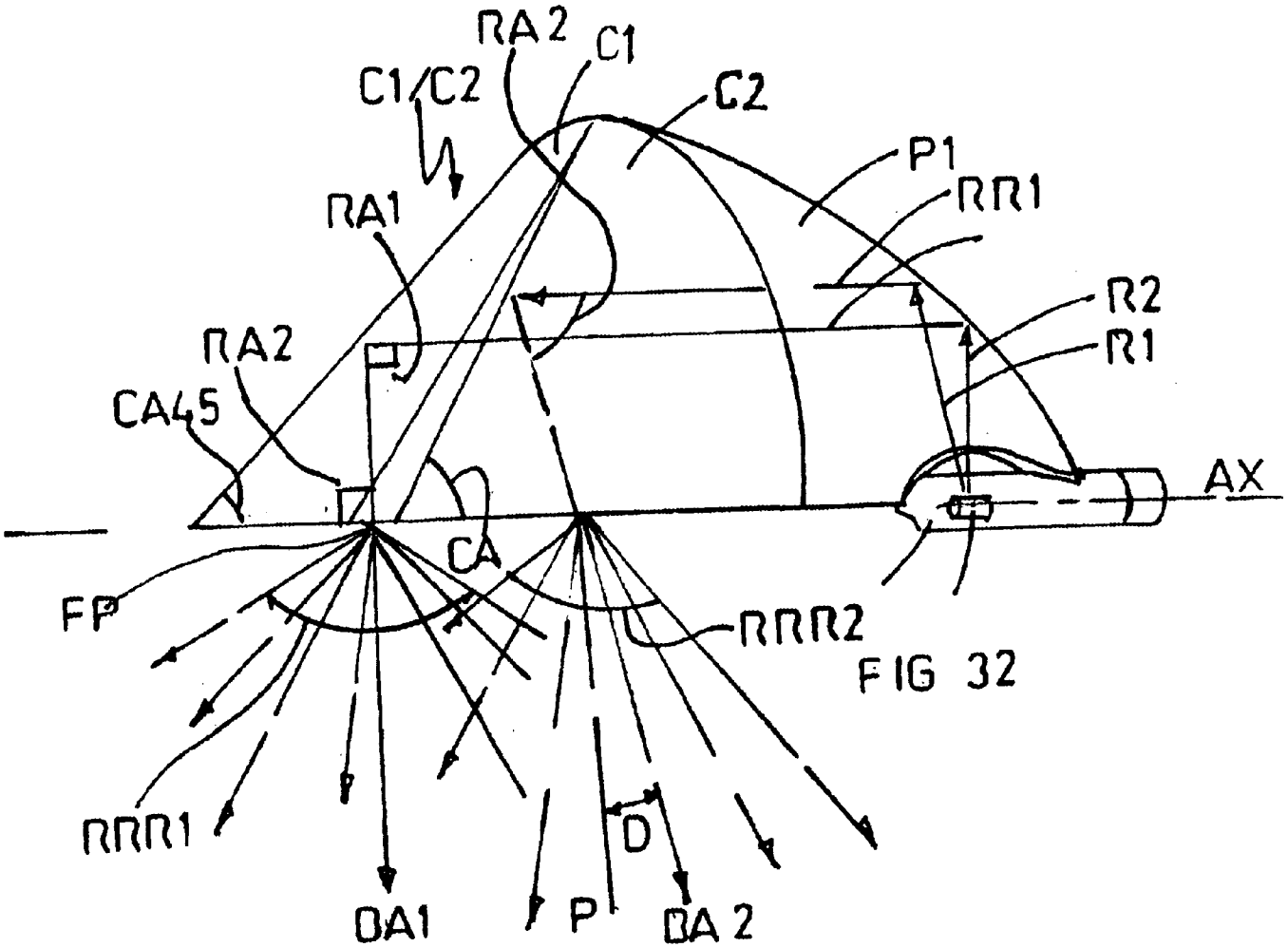
FIG. 32 is a schematic isometric view of another reflector system.

FIG. 32 is a three dimensional view of a reflector system comprised of a parabolic reflector P1 collecting and projecting rays R1 and R2 (that are radiating from quasi-point source 1 of lamp 2) toward or onto conical composite reflector C1/C2. Both rays R1 and R2 are perpendicular to lamp axis AX and are reflected off reflector P1 from different degrees on the same circumference of reflector P1. Composite reflector C1/C2 is comprised of two separate conical sections: section C1, which has a central angle of 45°, section CA45; and C2, which is flatter and has a central angle greater than 45°. Rays R1 are reflected off the parabolic surface of reflector P1 parallel to central axis AX toward reflector C1. Reflector C1 reflects rays RR1 as rays BA, which is perpendicular to lamp axis XA. For graphic purposes, BA1 is shown to be the central ray of radiant ray section RRR1. Rays R2 are reflected off parabolic surface P1 as rays RR2 parallel to central axis AX toward reflector C2. Reflector C2 reflects rays RR2 at acute angle RA2 as ray BA2. Ray BA2 is the central ray of radiant ray section RRR2 and is at an acute angle to line P, which is perpendicular to central axis AX. This optical configuration may be used to project segmented arcs of radial light distribution on differing distances from light axis AX.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A luminaire having a quasi point light source near a surface onto which light rays may impinge, comprising:

a lens system which includes a first optical element in the form of a radially collimating first ring or annular lens at least partially surrounding the light source and collimating at least some of the light from the source to impinge upon a surface, and a second optical element for receiving light rays and directing the rays to impinge upon the surface at a position radially or concentrically closer to the lens system than the rays from the ring lens.

2. A luminaire as defined in claim 1 wherein wherein the ring lens is a Fresnel lens said second optical element is a secondary lens and receives light rays from at least a portion of the Fresnel lens.

3. A luminaire as defined in claim 2 wherein said secondary lens radially surrounds said light source.

4. A luminaire as defined in claim 1 wherein said second optical element is a first reflector that radiallly distributes light and located above the light source.

5. A luminaire as defined in claim 4, further comprising a second reflector which is cylindrical and which reflects light from the light source to said first reflector.

6. A luminaire as defined in claim 2 wherein said second optical element is a radially collimating second Fresnel lens which refracts light rays from the source to impinge upon the surface in an area doser to the lens system than the rays from the first Fresnel lens.

7. A luminaire as defined in claim 6 wherein said second Fresnel lens is a portion of and joined to said first fresnel lens.

8. A lighting assembly having a quasi point light source near a surface onto which light rays may impinge, comprising:

two canted lens ring segments at least partially surrounding the light source radially and collimating at least some of the light from the source to impinge upon a surface, said lense ring segments each having an axis which is at an angle to refract light rays from the source toward the surface.

9. A lighting assembly as defined in claim 8 wherein said lens ring segments are aspherical.

10. A lighting assembly as defined in claim 8 wherein said lens ring segments are Fresnel elements.

11. A lighting assembly having a quasi point light source near at least one surface onto which light rays may impinge, comprising:

two radially collimating Fresnel ring lenses adjacent each other;

a quasi point light source common to said lenses and arranged in the vicinity where the lenses are closest to one another.

12. A lighting assembly as defined in claim 11 wherein said lenses are arranged at an angle with respect to one another.

13. A lighting assembly as defined in claim 12 wherein said light source has a longitudinal axis arranged approximately parallel to transverse diameters of both lenses.

14. A lighting assembly as defined in claim 13 further comprising a reflector disposed in an open area on the opposite side of the light source from said lenses to reflect light from the light source which are not refracted by said lenses.

15. A lighting assembly as defined in claim 13 wherein said light source is mounted for movement along a common axis which bisects the angle between the lenses.

16. A lighting assembly as defined in claim 11 wherein the light source and the lenses are constructed and arranged so that the light source is disposed at the focal point of both lenses.

17. A lighting assembly as defined in claim 13 further comprising a third Fresnel lens connected between the other Fresnel lenses.

18. A lighting assembly as defined in claim 11 wherein said lenses are arranged on opposite sides of the light source.

19. A lighting assembly as defined in claim 18 wherein the lenses each have lateral center axes and the light source has a vertical axis and a lateral axis, one of the lenses being positioned so that its lateral center axis is above the lateral axis of the light source and the other of the lenses being positioned so that its lateral center axis is below the lateral axis of the light source.

20. A lighting assembly as defined in claim 18 wherein the lenses each have lateral center axes and the light source has a vertical axis and a lateral axis, one of the lenses being positioned so that its lateral center axis is aligned with the lateral axis of the light source and the other of the lenses being positioned so that its lateral center axis is below the lateral axis of the light source.

21. A lighting assembly as defined in claim 18 wherein the lenses each have lateral center axes and the light source has a vertical axis and a lateral axis, the lenses being positioned so that their lateral center axes are below the lateral axis of the light source.

22. A lighting assembly as defined in claim 21 wherein the lateral axis of one lens is closer to the lateral axis of the light source than the lateral axis of the other lens.

23. A lighting assembly as defined in claim 11 further comprising a third lens which at least partially surrounds the light source, the two Fresnel lenses also at least partially surrounding the light source.

24. A lighting assembly as defined in claim 23 wherein the lenses have nearly equal F numbers.

25. A lighting asssembly as defined in claim 24 wherein at least one of the lenses has a different ratio of its height to the vertical dimension of the light source than the other lenses.

26. A lighting assembly, comprising:

a quasi point light source;

a radially collimating ring lens only partially surrounding said light source;

a reflector on the other side of the light source from said ring lens arranged to reflect light in the same radial plane as projected by the ring lens.

27. A lighting assembly, comprising a plurality of assemblies as defined in claim 26.

28. A lighting assembly as defined in claim 27 constructed and arranged so that reflected light is projected in a radial plane parallel to the radial plane of the ring lens.

29. A lighting assembly, comprising a quasi point light source an optical system including a plurality of radially collimating ring lenses, concentric with one another and the light source, said ring lenses being offset vertically with respect to one another.

30. A lighting assembly comprising:

a quasi point light source;

a radially collimating ring lens partially surrounding said light source;

a refracting ring partially surrounding said ring lens and having an inner surface and an outer surface, the outer surface being formed into a multiplicity of zones, at least some of said zones having multiple lenses therein, the lenses of each zone being of greater power than the lenses of adjacent zones; and a reflector on the other side of said source from said refracting ring for directing rays to said refracting ring.

31. A lighting fixture for being mounted on a plane to illuminate a surface on another plane perpendicular to the mounting plane, comprising:

a lighting assembly as defined in claim 28 the lighting assembly being constructed and arranged to that a defined geometric area on the illuminated surface is evenly lighted.

32. A fixture as defined in claim 31 wherein the refracting ring has sections which have differing amounts of light diverging power so as to provide uniform lighting on the ground plane.

33. A lighting assembly, comprising:

a quasi point light source;

a reflector assembly, having three reflector sections, one being parabolic and projecting a collimated beam and the other two sections being ellipsoidal and projecting a combined converging beam, the reflector assembly being constructed and arranged to produce a 180 degree in section columnar beam having varying divergence and concentric brightness.

34. A lighting assembly as defined in claim 33, further comprising a cone reflector positioned to receive the columnar beam and redirect it as a radially collimated beam.

* * * * *